US007369145B2

(12) United States Patent
Busch et al.

(10) Patent No.: US 7,369,145 B2
(45) Date of Patent: May 6, 2008

(54) METHOD AND APPARATUS FOR CONTROLLING THE UNIFORMITY OF PRINT DENSITY OF A THERMAL PRINT HEAD ARRAY

(75) Inventors: Brian D. Busch, Sudbury, MA (US); Dirk W. Hertel, Quincy, MA (US); Leif D. Hille, Natick, MA (US); Suhail S. Saquib, Shrewsbury, MA (US)

(73) Assignee: Polaroid Corporation, Concord, MA (US)

( * ) Notice: Subject to any disclaimer, the term of this patent is extended or adjusted under 35 U.S.C. 154(b) by 389 days.

(21) Appl. No.: 10/990,672

(22) Filed: Jan. 10, 2005

(65) Prior Publication Data

US 2006/0152573 A1 Jul. 13, 2006

(51) Int. Cl.
*B41J 2/36* (2006.01)

(52) U.S. Cl. ..... 347/188

(58) Field of Classification Search ..... 347/188, 347/191, 194, 195; 400/120.09
See application file for complete search history.

(56) References Cited

U.S. PATENT DOCUMENTS

| | | | | |
|---|---|---|---|---|
| 4,647,184 | A | 3/1987 | Russell et al. | 355/14 |
| 4,758,966 | A | 7/1988 | Brooks et al. | 364/519 |
| 4,827,279 | A | 5/1989 | Lubinsky et al. | 346/1.1 |
| 5,149,960 | A | 9/1992 | Dunne et al. | 250/226 |
| 5,343,142 | A | 8/1994 | Sasaki et al. | 324/71.1 |
| 5,469,068 | A | 11/1995 | Katsuma | 324/678 |
| 5,608,333 | A | 3/1997 | Hayashi | 324/711 |
| 5,608,442 | A | 3/1997 | Bennefeld et al. | 347/211 |
| 5,698,987 | A | 12/1997 | Hayashi | 324/711 |
| 5,852,369 | A | 12/1998 | Katsuma | 324/678 |
| 5,912,693 | A | 6/1999 | Katsuma et al. | 347/191 |
| 6,116,714 | A | 9/2000 | Imanaka et al. | 347/19 |
| 6,204,671 | B1 | 3/2001 | Katsuma | 324/678 |
| 6,283,650 | B1 | 9/2001 | Yamada et al. | 400/120.14 |
| 6,377,358 | B1 | 4/2002 | Hayasaki et al. | 358/1.16 |
| 6,404,208 | B1 | 6/2002 | Katsuma | 324/678 |
| 6,409,300 | B2 | 6/2002 | Imanaka et al. | 347/19 |
| 6,584,233 | B1 | 6/2003 | Kane et al. | 382/254 |
| 2003/0071866 | A1 | 4/2003 | Wong et al. | 347/19 |

FOREIGN PATENT DOCUMENTS

| | | |
|---|---|---|
| GB | 2 243 265 A | 10/1991 |
| GB | 2 356 375 A | 5/2001 |
| JP | 02289364 | 11/1990 |

*Primary Examiner*—Huan Tran

(57) ABSTRACT

A method for controlling the print density of individual heating elements of a thermal print head array determines respective energy values for each heating element in response to image pixel data to be printed, multiplies determined energy values by a respective predetermined correction factor for one or more respective heating elements for improving print density consistency between individual heating elements, and dithers adjusted energy values from the step of multiplying as a function of adjacent image pixels.

20 Claims, 6 Drawing Sheets

65

| | | |
|---|---|---|
| Calculate | $\bar{d}_m = \frac{1}{N}\sum_n d_{m,n}$ | 65A |
| Calculate | $\Delta d_{m,n} = \frac{d_{m,n}}{\bar{d}_m} - 1$ or $\Delta d_{m,n} = d_{m,n} - \bar{d}_m$ | 65B |
| Calculate | $\overline{\Delta d}_n = \frac{\sum_m w_m \Delta d_{m,n}}{\sum_m w_m}$ | 65C |
| Calculate | $D_n = \frac{1}{1 + f\overline{\Delta d}_n}$ | 65D |

METHOD AND APPARATUS FOR CONTROLLING THE UNIFORMITY OF PRINT DENSITY OF A THERMAL PRINT HEAD ARRAY

FIELD OF THE INVENTION

The present invention generally relates to printers that use thermal print head arrays, and in particular to such printers which compensate for streaking caused by variations within the print head.

BACKGROUND OF THE INVENTION

Thermal print head printers are well known and widely used for both single and multicolor applications. Thermal print heads take the form of linear arrays of closely spaced heating elements with each element defining a column of separately controllable printed image pixels. These heating element arrays are held in compressive contact with a heat sensitive print medium directly or through a heat sensitive donor ribbon containing ink, and heat from the elements develops inks within the print medium or transfers ink from the donor ribbon to the print medium. The print density produced by this process is dependent upon various physical aspects, including thermal efficiency of the heating elements, the amount of energy used per pixel, heat transfer characteristics of the heating elements and the heat sink, thermal contact between the heating elements and the thermal medium, etc. Unfortunately, inconsistencies between adjacent elements in any of these variables can result in variations of print density that are visible as streaks on the printed image. This problem is only confounded in higher speed printing applications where thermal characteristics are harder to control due to limited printing time per pixel and an inherent heat build up in the print head between sequentially printed pixels. Aging of the resistive heating elements can also increase the variation in their efficiency and thus print density over time.

It is therefore desirable for the control processes and systems for thermal print head arrays to include aspects for enhancing consistent print density between heating elements of an array to thereby minimize the appearance of image streaks and thus improve image quality.

One such system is described in U.S. Pat. No. 4,827,279, which system calculates a correction value for each heating element after measuring a printed sample on a transparent receiver with a microdensitometer. The respective correction values are then added to image pixel data to be printed by the respective heating elements.

SUMMARY OF THE INVENTION

One embodiment of the present invention provides a method for controlling the print density of individual heating elements of a thermal print head array, comprising the steps of determining respective energy values for each heating element of a thermal print head array in response to image pixel data to be printed, multiplying determined energy values from the step of determining by a respective predetermined correction factor for one or more respective heating elements for improving print density consistency between individual heating elements, and dithering adjusted energy values from the step of multiplying as a function of adjacent image pixels.

The correction factors may each represent a deviation of print density of a respective heating element from an average print density. The method may include a prior step of adjusting determined energy values according to each respective heating element in response to residual thermal effects from most recently printed image pixels, prior to the step of multiplying. The prior step of adjusting may include a step of determining residual thermal effects for each heating element from respective dithered energy values from the step of dithering. The step of determining residual thermal effects may include factoring out the respective correction factor from the dithered energy value of each image pixel. The step of multiplying may produce an amount of change in the determined energy values that is proportional to each determined energy value.

The method may further include a step of determining a correction factor for each heating element. The step of determining a correction factor may include the steps of printing a sample with a print head array, measuring print densities from the sample for each individual heating element, and calculating correction factors for respective individual heating elements from the measured print densities, wherein the correction factors each represent a deviation of print density of a respective heating element from an average print density. The step of measuring may include scanning the sample to collect print density data. The printed sample may include alignment marks printed in the sample, and the step of measuring may include the step of determining the collected data corresponding to each individual heating element in response to the alignment marks. The method may further comprising periodically repeating the steps of printing, measuring and calculating to identify significant changes in the correction factors and thereby print density consistency of the heating elements during long term operation of the print head array.

The method may further comprise the steps of initially measuring respective resistance values for each heating element, storing these initially measured resistance values for future reference, subsequently measuring respective resistance values for the heating elements after some amount of usage of the print head array, and determining respective adjusted correction factors for one or more heating elements in response to changes in the respective resistance values of individual heating elements between the step of initially measuring and the step of subsequently measuring. The step of determining respective adjusted correction factors may include multiplying correction factors used for respective individual heating elements during said step of initially measuring by a ratio of a respective subsequently measured resistance value to a respective initially measured resistance value.

Another embodiment of the present invention may reside in a printing apparatus having a thermal print head array of heating elements, wherein the improvement comprises a control system including a process for determining energy values for each heating element of a thermal print head array in response to received image pixel data, a process for correcting determined energy values respective to each heating element by an amount that is proportional to each respective determined energy value for improving print density consistency between individual heating elements, and a process for dithering adjusted energy values from the process for multiplying as a function of adjacent image pixels.

The process for correcting may include a process for multiplying determined energy values by respective predetermined correction factors for one or more respective heating elements. The improvement may further comprise a prior process for adjusting determined energy values according to each respective heating element in response to residual thermal effects from most recently printed image pixels, prior to the process for multiplying. The prior process for adjusting may include a process for determining residual thermal effects for each heating element from respective dithered energy values from the process for dithering.

The improvement may further comprise a process for initially measuring respective resistance values for each heating element and storing these initially measured resistance values for future reference, a process for subsequently measuring respective resistance values for the heating elements after some amount of usage of the print head array, and a process for determining respective adjusted correction factors for one or more heating elements in response to changes in the respective resistance values of individual heating elements between the process for initially measuring and the process for subsequently measuring. The process for determining respective adjusted correction factors may include a process for multiplying a current correction factor of an individual heating element by a ratio of a respective subsequently measured resistance value to a respective initially measured resistance value.

The control system may include a process for determining a correction factor for each heating element including the process steps of printing a sample with a print head array, measuring print densities from the sample, and calculating correction factors for respective individual heating elements from the measured print densities, wherein the correction factors each represent a deviation of print density of a respective heating element from an average print density. The control system may further include a process for periodically repeating the process steps of printing, measuring and calculating to identify significant changes in the correction factors and thereby print density consistency of the heating elements during long term operation of the print head array.

Yet another embodiment of the present invention provides a method for controlling the print density of individual heating elements of a print head array, comprising the steps of printing a sample with a print head array, measuring print densities from the sample for each individual heating element, calculating first correction factors for respective individual heating elements from the measured print densities for improving print density consistency between individual heating elements, implementing the first correction factors as multipliers of energy values used for printing with respective heating elements of the print head array; determining adjusted second correction factors for individual heating elements including sequentially repeating the steps of printing, measuring and calculating using implemented first correction factors, and subsequently implementing the second correction factors as multiplication products of individual second correction factors times their heating element respective first correction factors and substituting these second correction factor products in place of the first correction factors for printing with the print head array.

The step of measuring may include scanning the sample to collect print density data. The printed sample may include alignment marks printed in the sample, and the step of calculating may include step of determining the collected data corresponding to each individual heating element in response to the alignment marks.

The step of printing a sample may include using a gradient of medium range print densities for each heating element, or the steps of biasing print media towards the print head with a roller having a circumference, and printing a consistent medium density portion around the entire circumference of the roller. In the former case, the step of calculating may include averaging measured print densities for each heating element along a portion of the sample printed with the gradient of medium range print densities. In the latter case, the step of calculating may include averaging measured print densities for each heating element along the consistent medium density portion of the sample.

The print head array may have a pair of opposed ends which extend to at least one side edge of print media during printing operations including the step of printing the sample, and the step of measuring may include limiting density values measured along the at least one side edge of the print media for the sample.

The print head array may have at least one end which extends beyond a side edge of print media during printing operations, and the print energy used for individual heating elements located beyond the print media side edge may be increasingly reduced in the direction of the at least one end of the print head array.

The method may further comprise steps of determining further adjusted third correction factors for individual heating elements including repeating the steps of printing, measuring and calculating using the second correction factor products, and implementing the third correction factors as multiplication products of individual third correction factors times their heating element respective second correction factor products and substituting these third correction factor products in place of the second correction factor products for printing with the print head array.

Both the first described embodiment and this last described embodiment may further include periodically repeating the steps of printing, measuring and calculating to identify significant changes in the correction factors and thereby print density consistency of the heating elements during long-term operation of the print head array.

BRIEF DESCRIPTION OF THE DRAWINGS

The present invention is illustratively shown and described in reference to the accompanying drawings, in which.

DETAILED DESCRIPTION OF THE DRAWINGS

Figure 1:
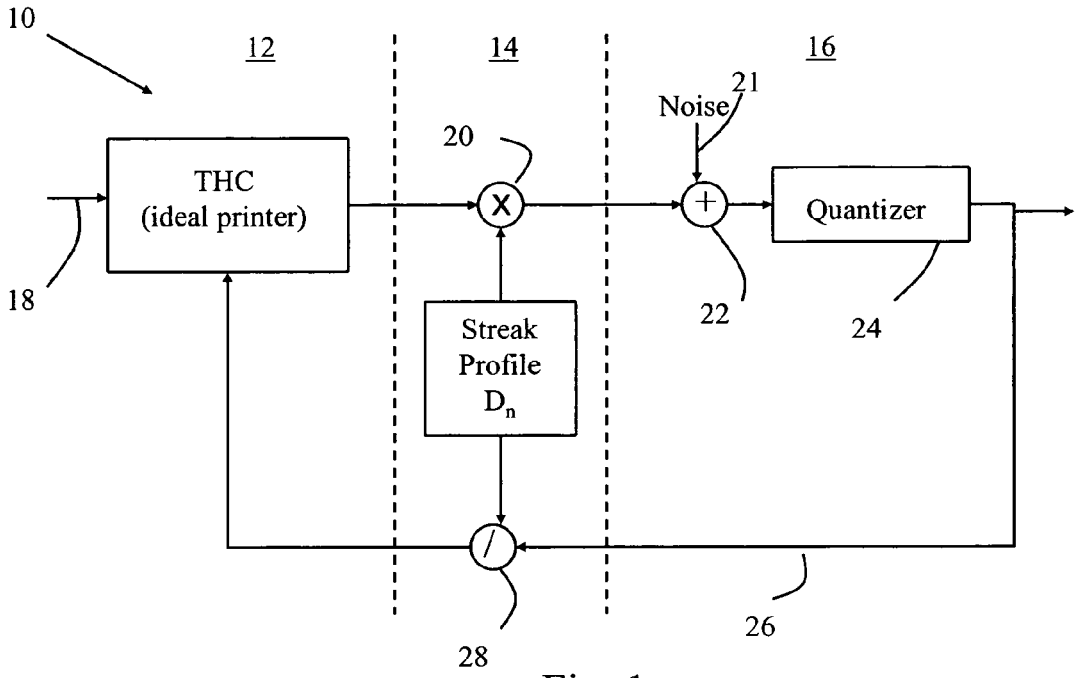
FIG. 1 is a block diagram of a signal processing system constructed in accordance with one embodiment of the present invention.

FIG. 1 is a block diagram of a signal processing circuit 10 constructed in accordance with one embodiment of the present invention. Circuit 10 includes image data conversion section 12, streak correction section 14 and a dithering section 16.

Image data conversion section 12 receives image data through an input 18 and converts the data for each pixel to at least one energy value for use in energizing an individual heating element of a thermal print head array. In one form, the energy values represent the amount of time that each heating element is energized for each respective pixel. In the case of color images, separate energy values are generated for the separate color components of each pixel. The present embodiment also adjusts those energy values in accordance with most recently printed pixels to compensate for residual heat build up in the print head array. For a more detailed explanation of this thermal compensation process, please refer to co-pending U.S. patent application entitled Thermal Response Correction System, Ser. No. 10/910,880 filed Aug. 4, 2004, the contents of which are hereby incorporated by reference herein.

Streak correction section 14 receives the energy values from conversion section 12 and a multiplier 20 multiplies each value by a respective streak profile correction factor, $D_n$, for each respective heating element. These correction factors are determined experimentally prior to normal printing operations, and the process of their determination is described in greater detail in reference to FIGS. 3-5. The correction factors are calculated with respect to unity (a factor of one), so that they represent heating response or print density deviations of the respective heating elements from an average heating response or print density. In this form, the print densities are more compatible with data conversion section 12, wherein calculations are also based upon on average heating response or print density.

The adjusted energy values resulting from the streak correction section 14 may not correspond directly to a limited set of energy states available in the printing process. Simply rounding the adjusted energy to the nearest available state may result in undesirable contouring artifacts in the printed image. Such artifacts will severely degrade the image quality when the number of available energy states is small. A process known as dithering is employed in section 16 to reduce the visibility of this contouring artifact. The process involves adding a predetermined pattern of noise 21 to the adjusted energy values. These noise signals are incorporated into the adjusted energy values by the adder 22. The repeating pattern spans adjacent heating elements as well as adjacent pixels printed by the same elements. The purpose is to bias the subsequent rounding introduced by the quantizer 24 either to the next higher or lower available energy state. The average of the quantized energy states over all the pixels in the repeating pattern more accurately represents the original adjusted energy. The human eye in observing the printed image at a normal viewing distance will perform a similar averaging and perceive a print density closer to the intended print density than would have been produced if the original adjusted energy was applied to the print head, thereby resulting in improved image quality.

As mentioned, image data conversion section 12 includes a process for compensating for the thermal effects of an ongoing printing process. For this purpose, dithering section 16 includes a feedback path 26 which returns the actual printing energy values used to the conversion section 12, as a record of thermal history. In an implementation where conversion section 12 compensates for thermal history on the basis of an ideal or standard heating element, it is necessary to remove the heating element respective correction factor, $D_n$, used in streak correction section 14. For this purpose, a divider 28 can be used in conjunction with the corresponding respective correction factor to adjust the feedback values. Alternatively, a multiplier can be used with the corresponding inverse correction factor to produce the same result. Once the energy value represents an ideal heating element, instead of the actual element, it can be used in the thermal correction process of conversion section 12. It should be noted that although elements 20 and 28 are referred to herein as multipliers or dividers, a similar result may be obtainable for purposes of the presently described process by the use of look-up tables.

Figure 2:
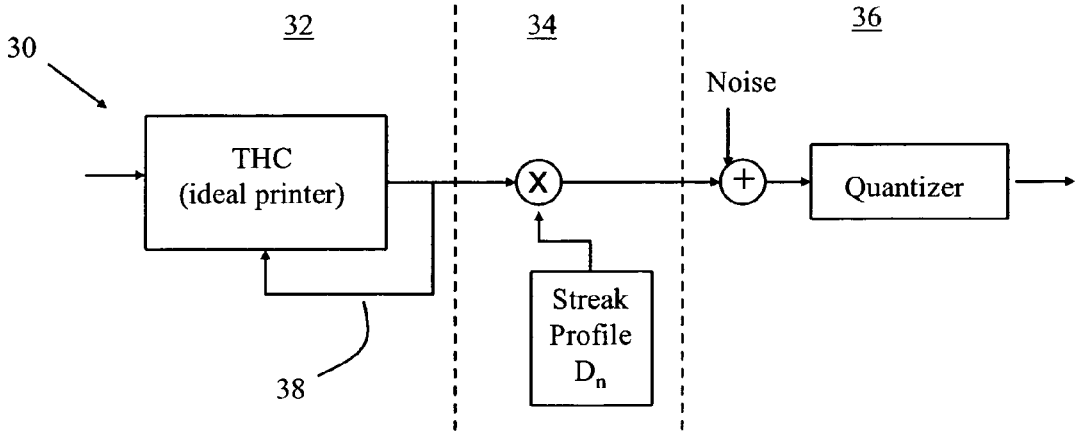
FIG. 2 is a block diagram of another signal processing system constructed in accordance with the embodiment of FIG. 1.

FIG. 2 shows an alternate embodiment of the circuit 10 of FIG. 1 in the form of signal processing circuit 30, which includes image data conversion section 32, streak correction section 34 and dithering section 36. Circuit 30 reduces the amount of processing power and/or memory required from circuit 10 by substitution of a smaller feedback path 38. In this manner, the energy levels calculated for ideal heating elements are used for thermal compensation without the variation produced from either the streak correction adjustments or the dithering process. The embodiment shown in FIG. 2 is a very good approximation to the embodiment shown in FIG. 1 when the number of available energy states is large.

Figure 3:
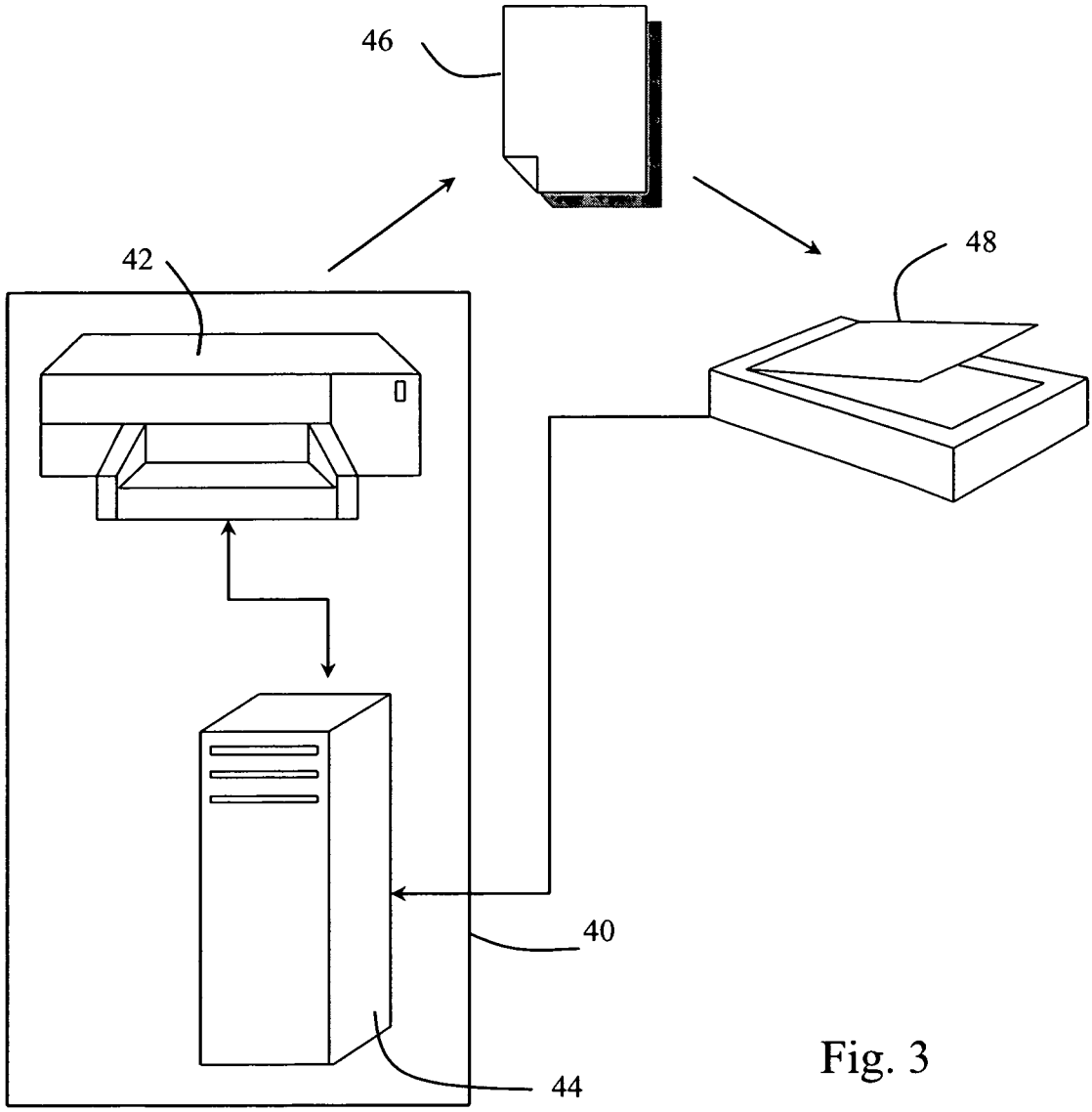
FIG. 3 is an operational diagram of a printing system being used in accordance with another embodiment of the present invention.

FIG. 3 depicts another embodiment of the present invention, which covers a method for estimating the correction factors for the individual heating elements of a print head array for the purpose of reducing print density inconsistencies between individual heating elements and thereby reducing the appearance of streaks in the resulting printed material. This method is performed with a printer apparatus 40, generally shown to include a printing mechanism 42 and a control system 44 for controlling printer mechanism 42, along with a scanner 48. The method generally includes printing a sample 46 with printer mechanism 42 and measuring print densities from the sample 46 by means of scanner 48. Scanner 48 generally functions under the direction of control system 44 and print density data measured by scanner 48 is collected in control system 44.

Control system 44 then takes the collected print density data and calculates a separate correction factor for each heating element for improving print density consistency between individual heating elements. The first calculated correction factors are then implemented by control system 44 into the printing operation of printer mechanism 42. The implemented first correction factors are then used in printer mechanism 42 for printing another sample 46, which is subsequently scanned by scanner 48 to measure the print densities produced with the use of the first correction factors. Control system 44 then takes the collected new density data and calculates an adjusted second set of correction factors for the individual heating elements. Lastly, control system 44 implements the second set of correction factors into the printing operation of print mechanism 42 as multiplication products of individual second correction factors times their heating element respective first correction factors and substituting these second correction factor products in place of the first correction factors.

The above described iterative steps of printing a sample, measuring print densities, calculating correction factors, and implementing those correction factors may be further repeated to thereby produce further sets of correction factors and refine the accuracy of the correction factors ultimately implemented in printing operations.

Figures 4, 5A:
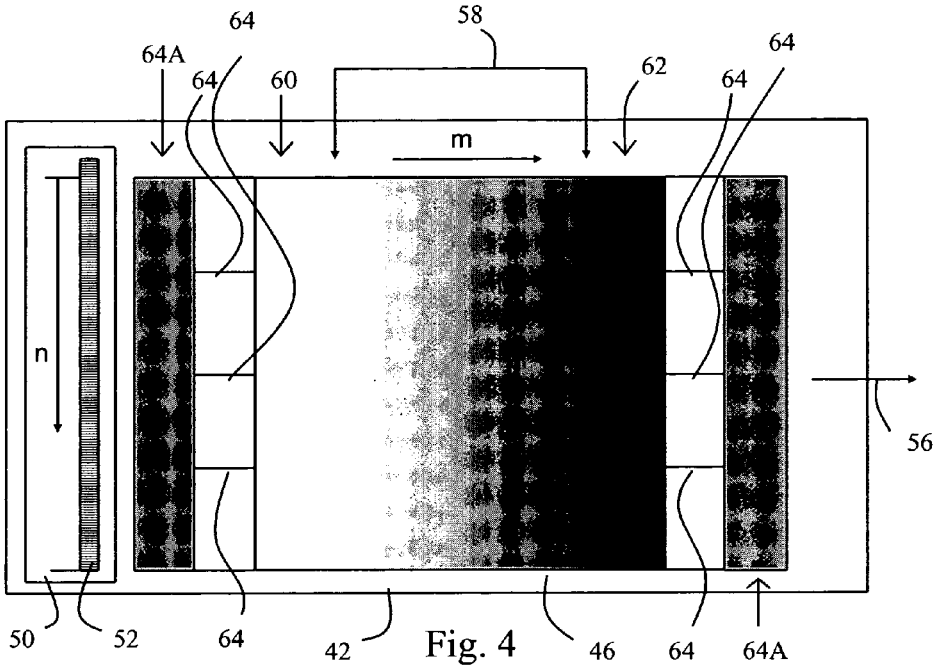
FIG. 4 is a representational diagram of a portion of the system of FIG. 3.
FIGS. 5A and 5B are flow diagrams of alternative processes which may be used in the embodiment of FIG. 3.

FIG. 4 pictorially represents printer mechanism 42 including a print head array 50 having a multiplicity of adjacently located heating elements 52. Printer mechanism 42 is further shown with a printed sample 46, which has just been printed by print head array 50 by moving sample 46 in the direction of arrow 56. Print sample 46 generally includes a central portion 58 having a gradient of medium range print densities produced by substantially all of the heating elements 52. Central portion 58 shows a gradient between maximum and minimum print density, beginning and end portions 60, 62, respectively; however the preferred sample includes a gradient of medium range print densities located around the center of portion 58 to ensure that the print system's range of densities most sensitive to system variations causing streaking is adequately covered. In print sample 46, such a range of densities is printed in the central portion 58. The print sample used to perform this analysis could also be of another form (such as a solid color field or a series of discrete steps in color density) providing that scanning and analysis of the density data yields a signal which is sufficiently strong to compensate for the streak-variation sought to be corrected.

Print sample 46 further includes a multiplicity of fiducials or alignment marks 64, which are printed by specific heating elements within array 50. The print sample might start with mid-density flat field bars 64A to heat up the printing system enough so that the printing of the alignment marks 64 is ensured under all possible printing conditions. Alignment marks 64 are used by control system 44 for aligning the print density data with the corresponding heating elements and thereby identifying the individual row of pixels printed by each of the respective heating elements 52. In other words, the collected print density data corresponding to each individual heating element is determined in response to the alignment marks. In another form, the process may include the steps of aligning collected print density data in accordance with the alignment marks and determining sample pixels printed by individual heating elements.

Once print sample 46 is scanned, and the scanned values are aligned in accordance with their respective heating elements, the aligned values are used for calculating respective print density correction factors for each heating element. FIG. 5A shows process 65 that may be used for calculating the individual correction factors. The measured density in the print sample is denoted as $d_{m,n}$, where the subscript n (FIG. 4) denotes the heating element number of all of the heating elements which actually print sample 46, and the subscript m (FIG. 4) denotes the print line number of the medium density lines within portion 58 (FIG. 4). Let N denote the total number of heating elements 52 (FIG. 4) printing the width of the print sample 46. First, the average line density $\overline{d_m}$ across the heating elements for each line in the central portion 58 is calculated in step 65A. Second, the deviation profile for the heating elements $\Delta d_{m,n}$ in each line is calculated in step 65B by dividing the measured density by the average line density and subtracting one from the ratio. Alternatively, the deviation profile may also be computed by subtracting the average line density from the measured density as shown in step 65B. Third, the average deviation profile $\overline{\Delta d_n}$ is calculated in step 65C by averaging the deviation profile across the lines in the central portion 58. In this step, a weighting function $w_m$ may be used for every line that may either reflect the contribution of that line to the streak sensitivity of the printing system, or the streak visibility. Finally, the correction factor $D_n$ is calculated using the equation shown in 65D. The factor f may be experimentally selected to provide the greatest print density consistency between heating elements, dependent upon the specific print head array application. In one embodiment, values closest to 0.6 were found to achieve best results in combination with multiple iterations of the sequence depicted in FIG. 3.

Figure 5B:
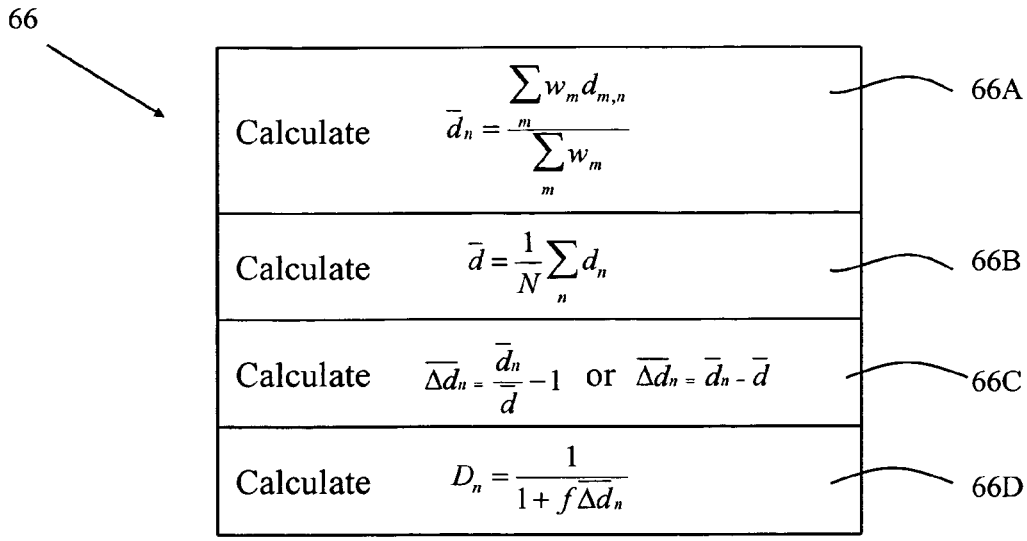

FIG. 5B shows an alternative process 66 for calculating the density correction factors. In this embodiment, the measured densities are weighted and averaged across the lines in step 66A to produce an average density $\overline{d}_n$ for each heating element n. Then a global average is calculated in step 66B by averaging all $\overline{d}_n$. An average deviation profile is calculated in step 66C by dividing the average density $\overline{d}_n$ for each heating element by the global average density and subtracting one from the ratio. Alternatively, the average deviation profile may also be computed by subtracting the global average density from the average density $\overline{d}_n$ for each heating element as shown in step 66C. Finally, the correction factors are obtained in step 66D using the same equation as in the embodiment shown in FIG. 5A.

Figure 6:
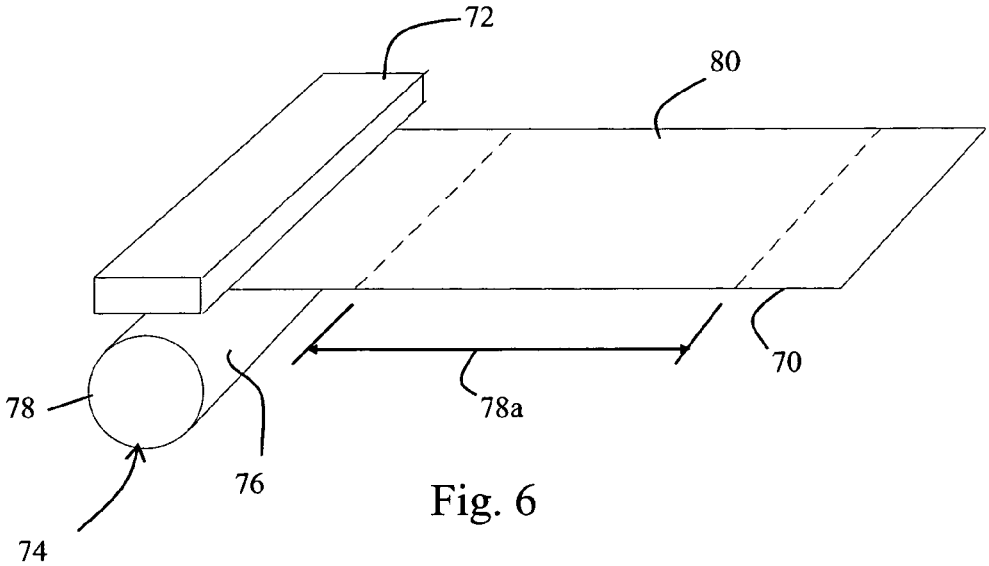
FIG. 6 is a representational diagram of an alternate version of the portion of FIG. 4.

FIG. 6 shows the printing of an alternate sample 70, which may be used for purposes of the present invention. FIG. 6 also pictorially includes a print head array 72 shown in combination with a roller 74, which biases the print media of sample 70 against print head array 72. Roller 74 includes a pressure surface 76 that has a certain circumference 78. In alternate sample 70, a central portion 80 is printed having a consistent medium density. In this manner, the print density data collected for individual heating elements of array 72 may be averaged over the length 78*a* of the circumference 78, to thereby average out inconsistencies which appear in the pressure surface 76 of roller 74. The individual correction factors are then calculated as described in reference to FIG. 5A-B.

Figure 7:
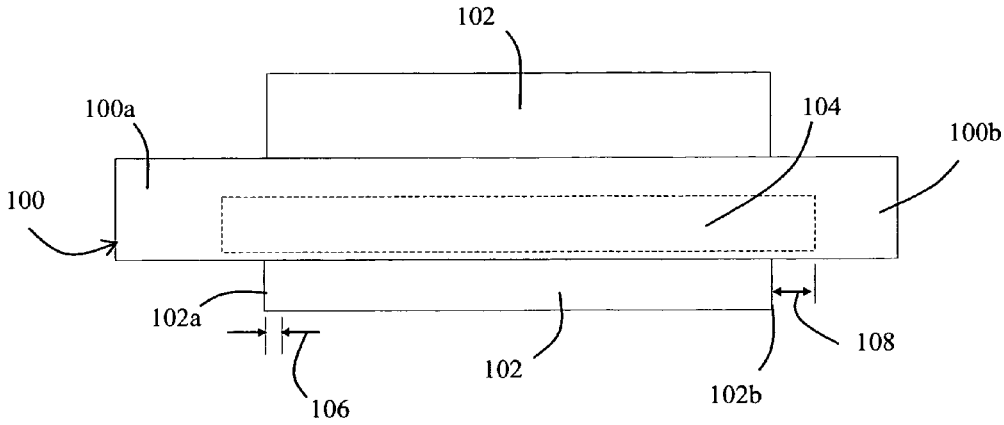
FIG. 7 is a representational diagram of a portion of the system of FIG. 3.

FIG. 7 pictorially shows a print head 100 being used to print on a print medium 102 to explain refinements of the process described herein to further improve print density consistency between heating elements. Print head 100 includes an array 104 of heating elements (shown in phantom), which extends between opposing ends 100*a*, 100*b* of print head 100. Array 104 also extends beyond opposing edges 102*a*, 102*b* of print medium 102.

It has been found that physical characteristics of media 102 can vary along the opposing edges 102*a*, 102*b* and thus cause inconsistent printing of print sample 46 (FIG. 3) in the immediate proximity of each edge 102*a*, 102*b*, exemplified by region 106. To correct for these inconsistencies, an average slope is determined for measured density values within region 106, and the measured values are limited to this average slope for calculating correction values.

A further correction technique is also depicted in FIG. 7 for heating elements that extend beyond the opposing edges 102*a*, 102*b* of print medium 102, as exemplified by region 108. Because the heating elements are not in contact with print media and the heat normally used for printing is not dissipated into print medium, this heat builds up faster than heat in the central portion of array 104. This built up heat can migrate to heating elements in contact with print medium 102 and cause higher than desired print densities. To help alleviate this heat build up, the energy values used for heating elements located beyond print medium edge 102*b* in region 108, are increasingly reduced for heating elements located further from edge 102*b* and towards print head end 100*b*. This reduction in the correction factors may also be extended slightly inwards from the edge 102*b* towards print head end 100*a* since in the actual printing the exact location of edge 102*b* may vary from print to print.

Figure 8:
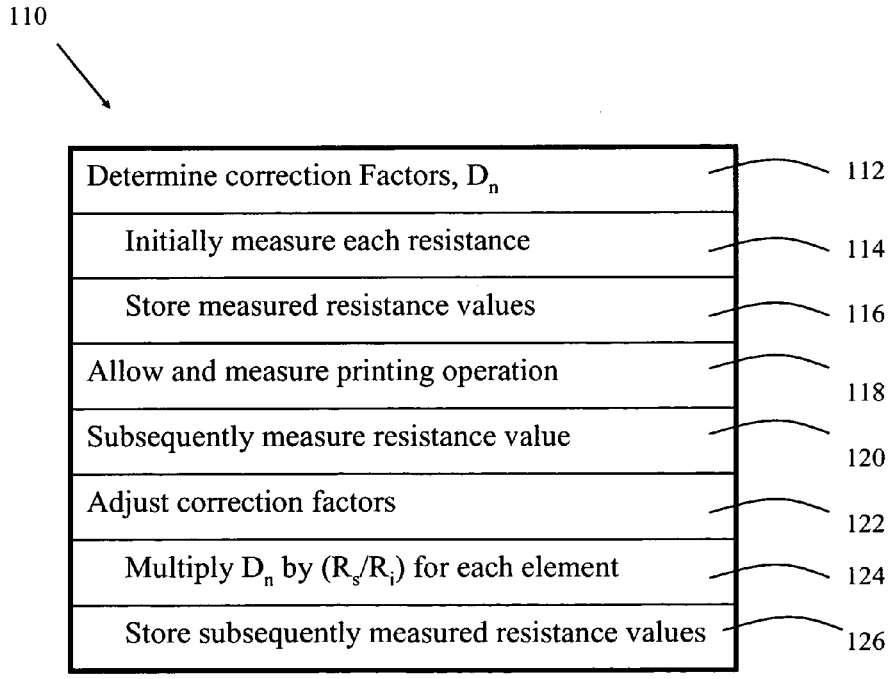
FIG. 8 is a flow diagram of a printing control process, which covers a refinement of the present invention.

FIG. 8 is a flow chart of a process 110 representing yet another refinement of the present invention. Process 110 deals with the long term operation of a printing apparatus and begins with step 112 of determining a print density correction factor for each heating element as described in reference to FIGS. 3-5. As part of step 112, step 114 includes initially measuring the resistance of each heating element of the array in a known manner. These initial measurements are stored in step 116 for future reference.

Process 110 then allows normal operation of the printer apparatus and measures that operation in step 118. Any suitable aspect of measurements may be used, including the number of prints, hours of operation, etc. After a predetermined amount of usage, step 120 makes a subsequent measurement of each heating element resistance, for the reason that resistances can change with usage.

Step 122 and then uses the stored initially measured resistance values and the subsequently measured resistance values to adjust the individual correction factors in response to the respective resistance changes. The adjustment is accomplished in step 124 which includes multiplying the current correction factor, $D_n$, for each heating element by the ratio of the respective subsequently measured resistance value, $R_s$, to the respective initially measured resistance value $R_i$.

The adjustment process of step 122 may be done automatically, or it may be contingent upon a sufficient change in each resistance value. Further, the subsequently measured values may also be stored in step 126 for making further correction factor adjustments after further printer usage has occurred.

Figure 9:
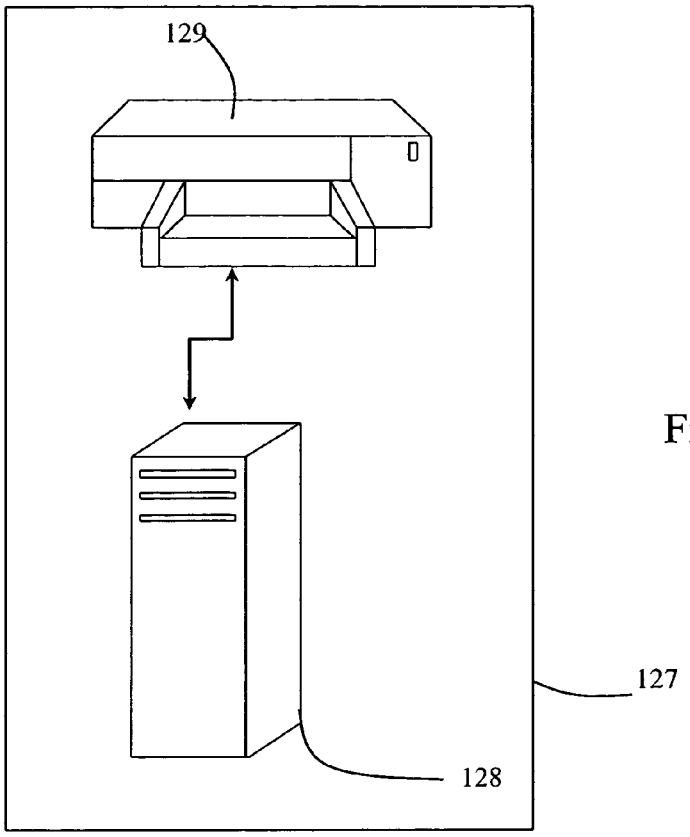
FIG. 9 is a representational diagram of a printing system constructed for use in accordance with a refinement of the present invention.
Figure 10:
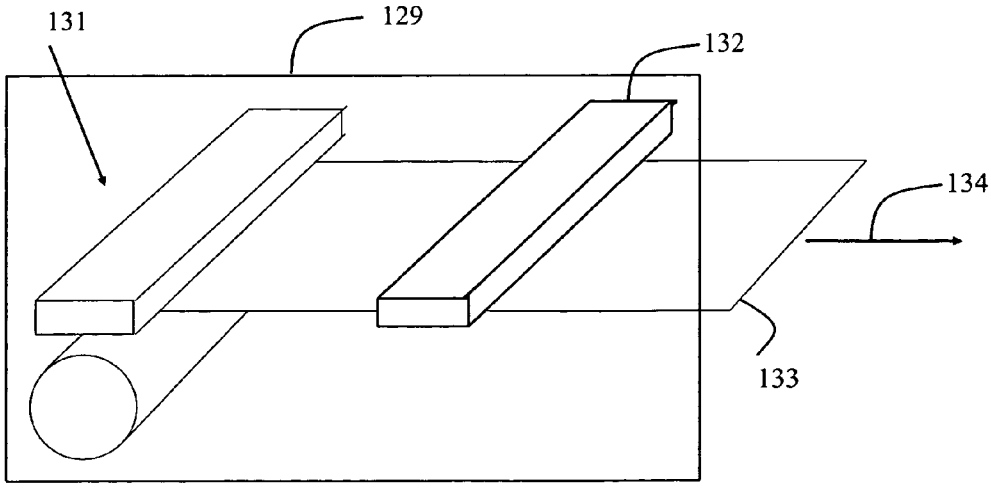
FIG. 10 is a representational diagram of a portion of the system of FIG. 9.

FIGS. 9 and 10 depict a further refinement of the present invention, which embodiment covers a method for controlling individual heating elements of a print head array for the purpose of reducing print density inconsistencies between individual heating elements and thereby reducing the appearance of streaks in the resulting printed material. A printer apparatus 127 generally includes a printing mechanism 129 with an embedded scanning capability and a control system 128 for controlling printer mechanism 129 and that embedded scanning capability. FIG. 10 depicts printing apparatus 129 and the position of a scanning head 132 located after the printing elements 131 along the general direction of motion 134 of print medium 133. The method generally includes printing a streak correction sample on medium 133 with printer elements 131 and immediately measuring print densities from the sample by means of embedded scanning head 132. Scanning head 132 functions under the direction of control system 128 and print density data measured by scanning head 132 is collected in control system 128. In this embodiment, analysis and subsequent corrections are performed as described in the previous embodiments.

Further functionality is provided by enabling full automation of the above-described streak correction process. Thus, correction factors may be recalculated periodically without requiring the presence of a service technician. Also, the general steps of printing a streak correction sample, measuring the print density and calculating new print density correction factors may be periodically performed over long term operation of printer apparatus 127 and used as a monitor for significant and sudden changes in correction factors and performance, which could indicate other performance issues or even trigger servicing of the apparatus. Lastly, the measured print density data could be uploaded via an internet or other suitable process, to allow remote inspection and analysis.

The above-described embodiments enjoy several advantages. Many of the processes described above may be implemented in software suitable for various systems thus allowing retrofitting to existing systems. The use of multiplier print density correction factors enhances the compatibility of the print density correction function with the print head thermal correction function and the dithering function, thus enhancing the combined performance of these functions. These multiplier correction factors are also readily adjusted over long term printing operations in response to heating element resistance changes without affecting or requiring recalibration of any other part of the control process. The use of an inexpensive scanner in the calibration process allows the present invention to be used for remote printing systems such as publicly available printing kiosks that allow anyone to do their own photo finishing of digital or printed images. Such kiosks often contain a suitable scanner to allow periodic recalibration by a service technician, or a simple scanner can be brought to the system by the technician. The computing power used in such kiosks is more than sufficient to run the required software. Alternatively, the printed samples may be sent to a separate location by any suitable means for independent analysis and calculation of correction factors, which then might be downloaded back to the kiosk. Lastly, incorporating a scanning head in the printing apparatus increases the amount of remote monitoring and maintenance that can be performed.

The present invention is illustratively described above in reference to the disclosed embodiments. Various modifications and changes may be made to the disclosed embodiments by persons skilled in the art without departing from the scope of the present invention as defined in the appended claims.

What is claimed is:

1. A method for controlling the print density of individual heating elements of a thermal print head array, comprising the steps of:

determining respective energy values for each heating element of a thermal print head array in response to image pixel data to be printed;

multiplying determined energy values from said step of determining by a respective predetermined correction factor for one or more respective heating element for improving print density consistency between individual heating elements; and dithering adjusted energy values from said step of multiplying as a function of adjacent image pixels.

2. The method of claim 1, wherein the correction factors each represent a deviation of print density of a respective heating element from an average print density.

3. The method of claim 1, further comprising a prior step of adjusting determined energy values according to each respective heating element in response to residual thermal effects from most recently printed image pixels, prior to said step of multiplying.

4. The method of claim 3, wherein said prior step of adjusting includes a step of determining residual thermal effects for each heating element from respective dithered energy values from said step of dithering.

5. The method of claim 4, wherein said step of determining residual thermal effects includes factoring out said respective correction factor from the dithered energy value of each image pixel.

6. The method of claim 1, wherein said step of multiplying produces an amount of change in the determined energy values that is proportional to each determined energy value.

7. The method of claim 1, further comprising a process for determining a correction factor for each heating element including the steps of:

printing a sample with a print head array;

measuring print densities from the sample; and calculating correction factors for respective individual heating elements from the measured print densities, wherein the correction factors each represent a deviation of print density of a respective heating element from an average print density.

8. The method of claim 7, wherein the step of measuring includes scanning the sample to collect print density data.

9. The method of claim 8, wherein the printed sample includes alignment marks printed in the sample, and further wherein the step of measuring includes the step of determining the collected data corresponding to each individual heating element in response to the alignment marks.

10. The method of claim 7, further comprising periodically repeating the steps of printing, measuring and calculating to identify significant changes in the correction factors and thereby print density consistency of the heating elements during long term operation of the print head array.

11. The method of claim 1, further comprising the steps of:

initially measuring respective resistance values for each heating element;

storing these initially measured resistance values for future reference;

subsequently measuring respective resistance values for the heating elements after some amount of usage of the print head array; and determining respective adjusted correction factors for one or more heating elements in response to changes in the respective resistance values of individual heating elements between the step of initially measuring and the step of subsequently measuring.

12. The method of claim 11, wherein the step of determining respective adjusted correction factors includes multiplying correction factors used for respective individual heating elements around said step of initially measuring by a ratio of a respective subsequently measured resistance value to a respective initially measured resistance value.

13. In a printing apparatus having a thermal print head array of heating elements, wherein the improvement comprises a control system including:

a process for determining energy values for each heating element of a thermal print head array in response to received image pixel data;

a process for correcting determined energy values respective to each heating element by an amount that is proportional to each respective determined energy value for improving print density consistency between individual heating elements; and a process for dithering adjusted energy values from said process for multiplying as a function of adjacent image pixels.

14. The apparatus of claim 13, wherein said process for correcting includes a process for multiplying determined energy values by respective predetermined correction factors for one or more respective heating elements.

15. The apparatus of claim 13, further comprising a prior process for adjusting determined energy values according to each respective heating element in response to residual thermal effects from most recently printed image pixels, prior to said process for multiplying.

16. The apparatus of claim 15, wherein said prior process for adjusting includes a process for determining residual thermal effects for each heating element from respective dithered energy values from said process for dithering.

17. The apparatus of claim 13, further comprising:

a processes for initially measuring respective resistance values for each heating element and storing these initially measured resistance values for future reference;

a processes for subsequently measuring respective resistance values for the heating elements after some amount of usage of the print head array; and a process for determining respective adjusted correction factors for one or more heating elements in response to changes in the respective resistance values of individual heating elements between the process for initially measuring and the process for subsequently measuring.

18. The apparatus of claim 17, wherein the process for determining respective adjusted correction factors includes a process for multiplying a current correction factor of an individual heating element by a ratio of a respective subsequently measured resistance value to a respective initially measured resistance value.

19. The apparatus of claim 13, further comprising a process for determining a correction factor for each heating element including the process steps of:

printing a sample with a print head array;

measuring print densities from the sample; and calculating correction factors for respective individual heating elements from the measured print densities, wherein the correction factors each represent a deviation of print density of a respective heating element from an average print density.

20. The apparatus of claim 19, further comprising a process for periodically repeating the process steps of printing, measuring and calculating to identify significant changes in the correction factors and thereby print density consistency of the heating elements during long term operation of the print head array.

* * * * *